United States Patent [19]

Craigie

[11] 4,442,556

[45] Apr. 17, 1984

[54] SOFA BED WITH INFLATABLE MATTRESS

[76] Inventor: William A. Craigie, 3602 W. 40th St., Minneapolis, Minn. 55410

[21] Appl. No.: 470,925

[22] Filed: Mar. 1, 1983

[51] Int. Cl.[3] ..... A47C 17/04; A47C 27/10

[52] U.S. Cl. ..... 5/13; 5/12 R; 5/455; 5/465

[58] Field of Search ..... 5/12 R, 13, 470, 471, 5/455, 464, 465

[56] References Cited

U.S. PATENT DOCUMENTS

| | | | |
|---|---|---|---|
| 1,271,672 | 7/1918 | Crowley et al. | 5/465 |
| 2,247,667 | 7/1941 | Rosberger | 5/465 |
| 2,545,311 | 3/1951 | Rosberger | 5/465 |
| 3,555,581 | 1/1971 | Friant | 5/465 |
| 3,934,281 | 1/1976 | Brindisi | 5/13 |
| 4,004,305 | 1/1977 | Rubin | 5/465 |
| 4,204,287 | 5/1980 | Lane et al. | 5/13 |
| 4,326,309 | 4/1982 | Flaum | 5/465 |
| 4,346,489 | 8/1982 | McMullan | 5/455 |

FOREIGN PATENT DOCUMENTS

| | | | |
|---|---|---|---|
| 1087 | 3/1931 | United Kingdom | 5/455 |

*Primary Examiner*—Alexander Grosz

*Attorney, Agent, or Firm*—Williamson, Bains, Moore & Hansen

[57] ABSTRACT

A sofa bed includes a fixed frame which is provided with a conventional foldable, sectional sofa bed frame. The sofa bed frame is foldable and unfoldable between collapsed and extended positions in a conventional manner. The sofa bed also includes a sectional mattress which includes inner, outer and intermediate inflatable mattress sections which are hingedly connected together. The mattress sections in the unfolded condition serve as a full mattress, and when in the folded condition constitute part of the sofa.

3 Claims, 7 Drawing Figures

SOFA BED WITH INFLATABLE MATTRESS

SUMMARY OF THE INVENTION

This invention relates to sofa beds, and more particularly to sofa beds having a full size, foldable, sectional mattress.

There are various commercial sofa beds all having mattresses which are folded with the sofa bed frame when the sofa bed is in the collapsed position. However, because of the conventional parameters of sofa beds, these mattresses have a thickness dimension substantially less than the full size bed mattress. Because sofa bed mattresses must be relatively thin, these mattresses have been found to be uncomfortable by many people. It is not believed that anyone has accommodated a sofa bed with a full size mattress.

It is therefore a general object of this invention to provide a novel sofa bed having a mattress which corresponds in substantially all material respects to a full size bed mattress.

It is a more specific object of this invention to provide a sofa bed with a comfortable full size sectional mattress which, when in the folded condition, serves as a highly attractive back rest portion of a sofa.

These and other objects and advantages of this invention will more fully appear from the following description made in connection with the accompanying drawings, wherein like reference characters refer to the same or similar parts throughout the several views.

FIGURES OF THE DRAWINGS

DESCRIPTION OF THE PREFERRED EMBODIMENT

Figure 1:
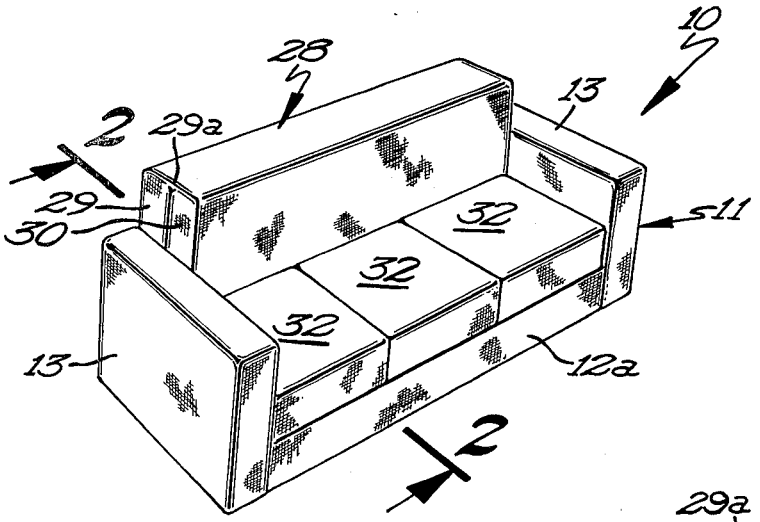
FIG. 1 is a front perspective view of the novel sofa bed in the folded position.

Referring now to the drawings, and more specifically to FIG. 1, it will be seen that one embodiment of the novel sofa bed, designated generally by the reference numeral 10, is thereshown. Sofa bed 10 includes a fixed frame 11 comprising an elongate, vertically disposed back frame 12 which extends between and is secured at its ends to side frame members 13. The back frame member 12 includes a pair of spaced apart, substantially parallel back frame elements 14 which are rigidly secured together at their respective bottom edges by bottom frame elements 15. Suitable foot elements 16 are secured to the side frame members 13. An upwardly opening chamber 17 is defined by the back frame elements 14.

The fixed frame also includes an elongate substantially straight front board **12*a* which extends between the side frame members 13 and adjacent the front end thereof. It will be noted that the front board 12*a*** has a vertical dimension substantially less than the vertical dimension of the back frame members.

The movable frame 18 includes a generally rectangular shaped inner frame section 19, a first intermediate frame 20, a second intermediate frame section 21 and an outer frame section 22. These frame sections are pivotally connected together and are of conventional well-known construction. Elongate leg elements 23 and elongate elements 24 are pivotally connected at their upper ends to opposite sides of certain of the frame sections and are swingable between a lowered frame-supporting and a collapsed retracted position. These leg elements are interconnected by a linkage 25 which is also connected to the fixed frame and this linkage serves to facilitate swinging movement of the frame sections and leg elements during folding and unfolding thereof. The entire movable frame is of well-known conventional construction and operation, and, per se, does not constitute part of the present invention.

The fixed frame defines an interior recess 26 which accommodates the folded, movable frame 18 therein. It will also be seen that the movable frame is provided with suitable springs 27 which extend between and are secured to the frame elements of each frame section.

The sofa bed 10 is also provided with a sectional mattress 28 including an inner mattress section 29, an intermediate mattress section 30 and an outer mattress section 31. These mattress sections are formed of a foamed material **28*a* covered by a cover 28*b*. It will be noted that the inner and intermediate sections 29 and 30 are interconnected together by hinge 29*a*, and the intermediate and the outer sections 30 and 31 are interconnected together by hinge 30*a*. The hinges 29*a* and 30*a* are actually formed by the cover material 28*b*. However, it is pointed out that the sections 30 and 31** may be completely detached from each other.

Figure 4:
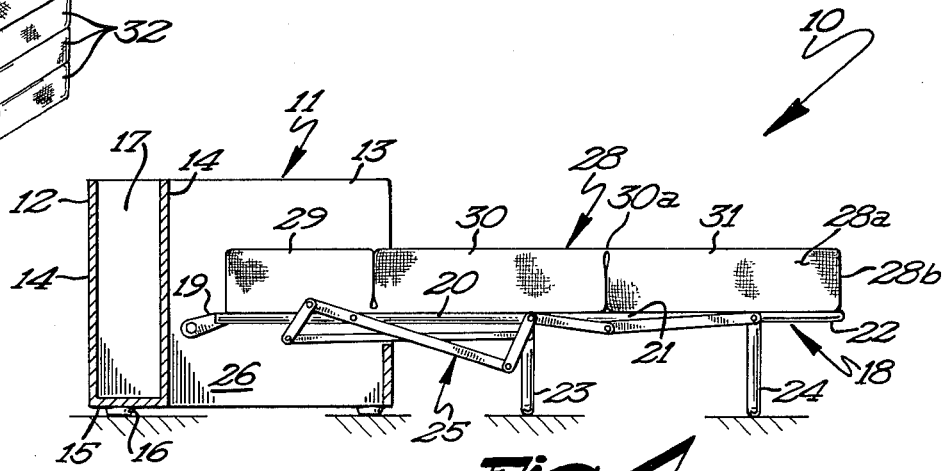
FIG. 4 is a side view, partly in section, illustrating the sofa bed in the extended position.

Referring now to FIG. 4, it will be seen that when the sectional mattress 28 is in the extended, horizontal position, the hinge **29*a* is disposed adjacent the lower surface of the mattress, and the hinge 30*a* is located adjacent the upper surface of the mattress. Thus, the hinges 29*a* and 30*a*** are located adjacent opposite surfaces of the sectional mattress when the latter is in the extended horizontal position.

The sofa bed 10 is also provided with a plurality of seat cushions 32 which may be formed of a foamed material, and which are provided with suitable covers. In the embodiment shown, three such seat cushions are provided.

Figure 2:
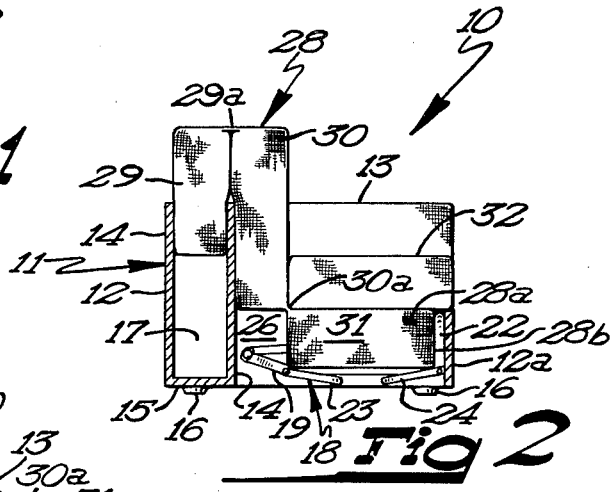
FIG. 2 is a cross-sectional view taken approximately along line 2—2 of FIG. 1 and looking in the direction of the arrows.
Figure 3:
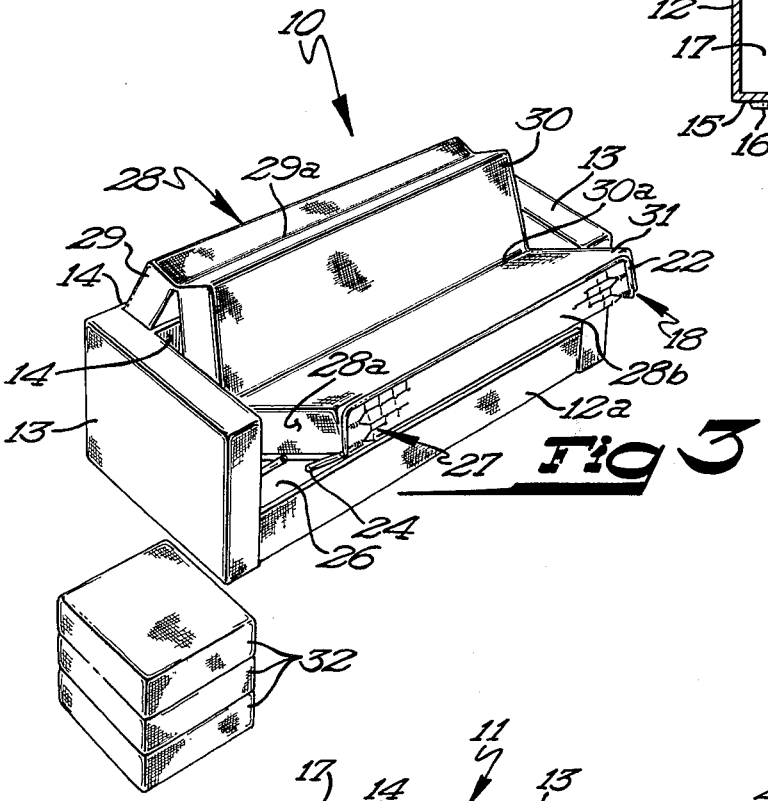
FIG. 3 is a front perspective view similar to FIG. 1 with the seat cushions thereof removed from the sofa and with the sofa bed frame and sectional mattress illustrated in a partially folded condition.

In use, when the sofa bed 10 is used as a conventional sofa, the movable frame 18 will be disposed in a folded, collapsed position, as illustrated in FIG. 2, in a well-known manner, and will be disposed within the cavity 26 by the components of the fixed frame. The outer mattress section 31 will be positioned upon the collapsed movable frame, and in particular upon the intermediate frame section. The intermediate mattress 30 will be vertically disposed against the innermost vertical frame element 14 of the back rame 12 and will serve as the front surface of the back rest of the sofa. The inner mattress section 29 will also be vertically disposed, as best seen in FIG. 2, and will project downwardly into the cavity 17 defined in the back rest. Blankets, sheets and bed pillows may also be positioned within the cavity 17 as desired. It will therefore be seen that when the sofa bed is in the folded condition, the sofa bed presents a highly attractive appearance. The cushions 32 will be disposed upon the outer mattress section and will engage the front surface of the intermediate mattress section.

When it is desirable to convert the sofa bed into a bed, the cushions 32 will be removed and the movable frame 18 will be extended in a well-known manner. When the movable frame is extended, the frame will be disposed in a horizontal position, and the sectional mattress 28 will be positioned upon the springs of the frame, as best seen in FIG. 4. The mattress 28 is a full size mattress in terms of the thickness dimension and corresponds to the thickness of a full size bed mattress. Thus, the sectional mattress 28 provides the same comfort factor found in the quality full size bed mattresses. This is a complete departure from the conventional thin sofa bed mattresses which have been found to be highly uncomfortable by many users.

When the sofa bed is again folded to form a sofa, the sectional mattress will also be folded and, as pointed out above, will present a very attractive back rest for the sofa and also provide a cushion support for the cushions 32.

Figure 5:
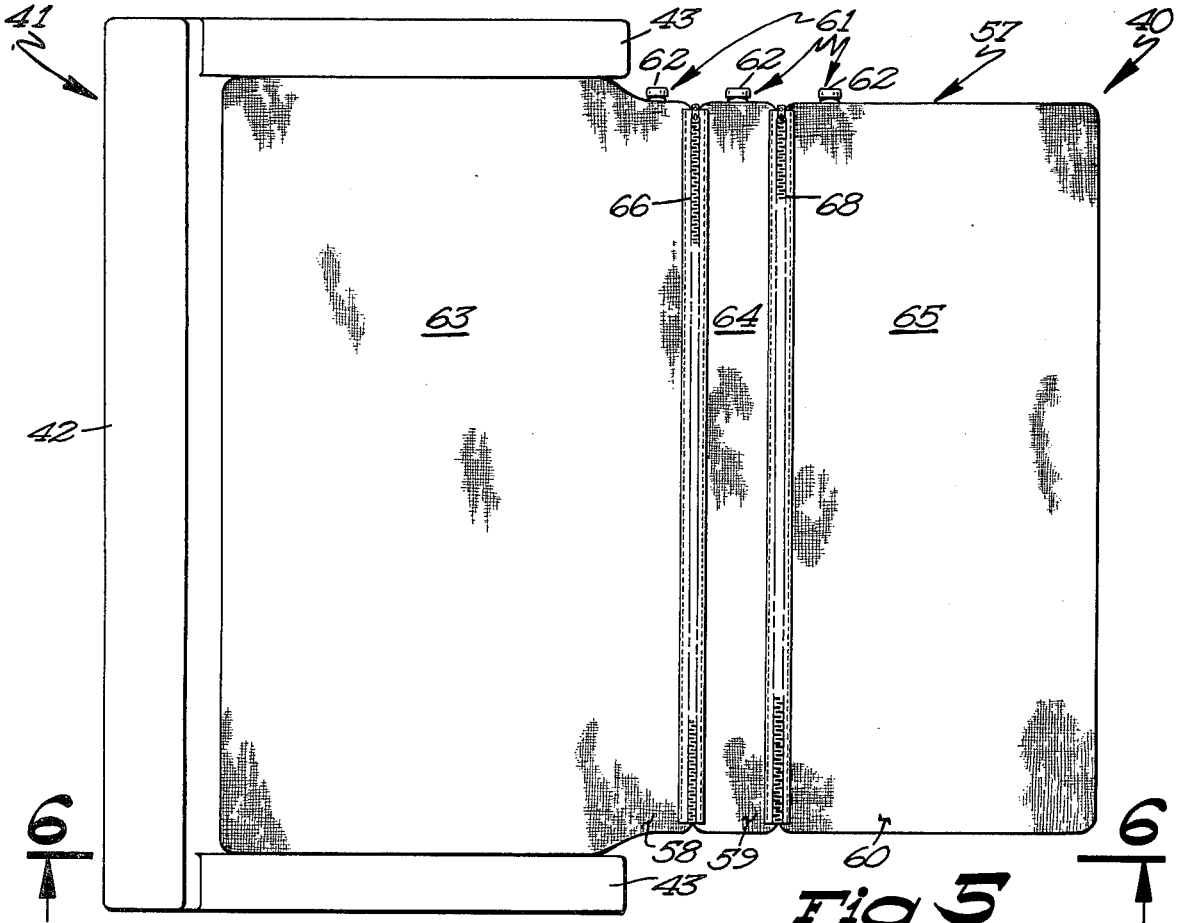
FIG. 5 is a top plan view of a different embodiment of the novel sofa bed.
Figure 6:
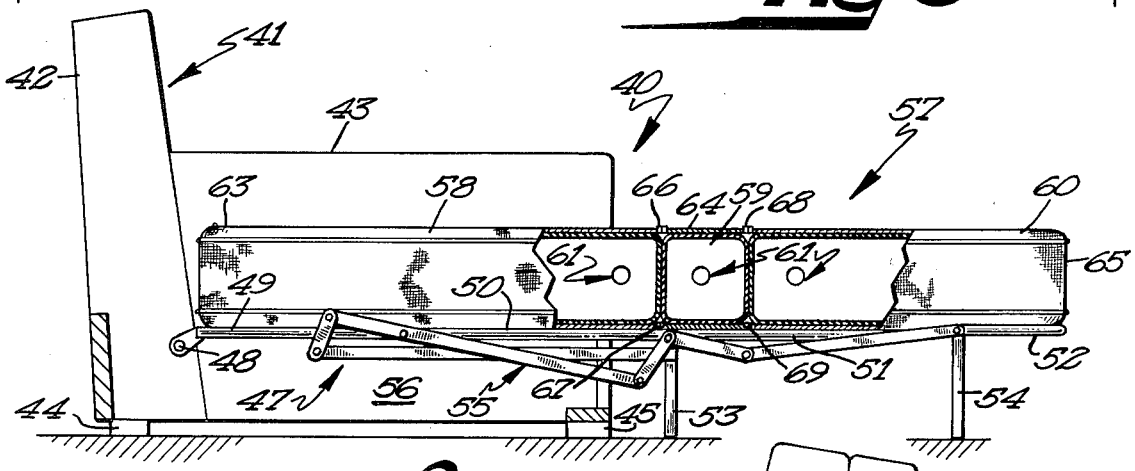
FIG. 6 is a cross-sectional view taken along line 6—6 of FIG. 5 and looking in the direction of the arrows.
Figure 7:
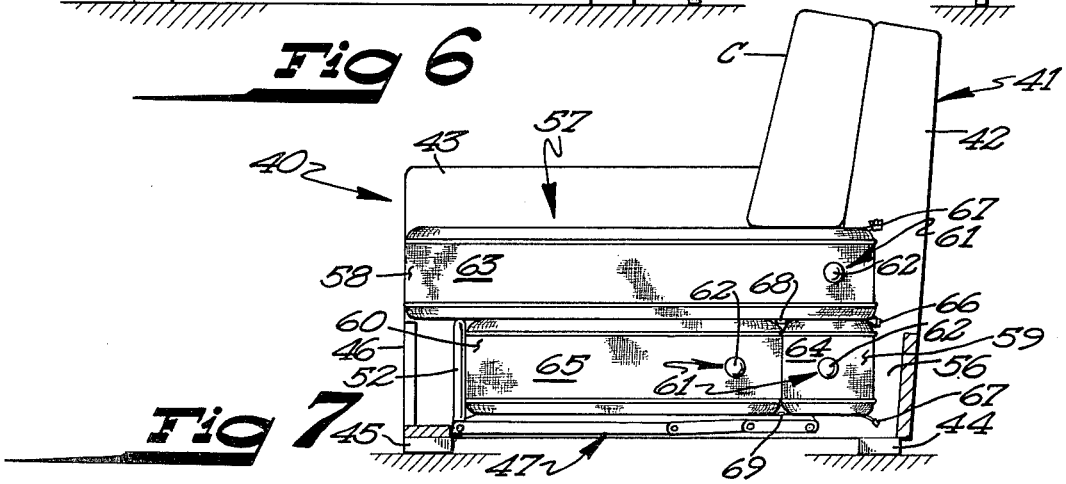
FIG. 7 is a side elevational view of the embodiment of FIG. 5 but illustrated in a folded condition with certain parts thereof broken away for clarity.

Referreing now to FIGS. 5, 6 and 7, it will be seen that a different embodiment of the novel sofa bed, designated generally by the reference numeral 40, is thereshown. The sofa bed 40 also includes a fixed frame 41 which is comprised of a back frame member 42 that is generally vertically disposed and which extends between and is rigidly connected to side frame members 43. The back frame member and side frame members may be suitably upholstered in a conventional manner. Rear foot elements 44 are secured to the back frame member, and front foot elements 45 are affixed to the side frame members adjacent the front end portion thereof. The fixed frame also includes a front board 46 that extends between and is secured to the side frame members adjacent the front thereof.

The sofa bed also includes a movable frame 47 which is movable between a folded condition, as illustrated in FIG. 7, to an extended condition, as illustrated in FIGS. 5 and 6. The movable frame 47, when in an extended condition, is of generally rectangular shaped configuration. The movable frame includes an inner frame section 49, a first intermediate frame section 50, a second intermediate frame section 51 and an outer frame section 52. The inner frame section 49 is pivoted to the fixed frame by a pivot 48. These frame sections are of generally rectangular configuration and are pivotally connected together in a well-known manner.

Elongate leg elements 53 and 54 are pivotally connected at their respective upper ends to opposite sides of certain of the frame sections, and are swingable between a lowered frame supporting and collapsed, retracted position. These leg elements are interconnected by a linkage 55 which is also connected to the fixed frame and movable frame sections to facilitate swinging movement of the frame sections and leg elements during folding and unfolding thereof. It is again pointed out that the movable frame is of well-known conventional construction and operation, and, per se, does not constitute part of the present invention. It is further pointed out that the movable frame is provided with suitable springs which extend between and are secured to the frame sections in the manner of the embodiment of FIGS. 1 to 4. The movable frame, when in the folded condition, is movable into a recess 56 defined by the fixed frame.

The sofa bed 40 also includes a sectional mattress 57 which is comprised of an inner section 58, a central section 59 and an outer section 60. Each of these sections comprises an inflated air section, and each is provided with a valve 61 having a suitable cover 62. The sections may be inflated by any conventional household device, such as a vacuum cleaner or a conventional home-type hair dryer. When inflated, each section has a depth or thickness dimension of approximately 8 inches, which is the dimension of the conventional mattress. It will be seen that the length dimension of the inner section 58 is substantially greater than the outer section 60. The intermediate section 59 has a length dimension substantially less than the outer section and its length dimension corresponds generally to its thickness dimension. The valves for each section also allow a user to vary the degree of inflation of each section individually and thereby vary the degree of rigidity of the mattress.

The inner section 58 is provided with a suitable fabric cover 63 which covers all but the front vertical face thereof. The intermediate section 59 is also provided with a cover 64 which covers all but the front and rear vertical faces of the section. The outer section 60 is provided with a cover 65 which covers all but the rear vertical face thereof. The covering material is an upholstery fabric conventionally used in making sofa beds.

An upper zipper 66 and a lower zipper 67 secure the cover of the inner section 58 with the cover 64 of the intermediate section 59. An upper zipper 68 and a lower zipper 69 secure the cover of the outer section 60 with the cover of the intermediate section 59 when the sections are in an extended condition, as illustrated in FIGS. 5 and 6. On the other hand, when the sofa bed is in a folded condition, the zipper 67 is unzipped to permit folding of the intermediate section and outer section as a unit relative to the inner section 58. Referring again to FIG. 7, it will be seen that when in the folded condition, the inner section 58 actually forms the seat of the sofa, while the intermediate section 59 and the outer section 60 are positioned therebelow. It will further be noted that, when in the folded condition, the intermediate section 59 is positioned rearwardly relative to the outer section 60.

From the foregoing description, it will be seen that I have provided a novel sofa bed which is characterized by the provision of a unique, full size comfortable sectional mattress which is not only of simple and inexpensive construction, but one which functions in a more efficient manner than any heretofore known comparable mattress.

While the preferred embodiments of the present invention have been described, it should be understood that various changes, adaptions and modifications may be made therein without departing from the spirit of the invention and the scope of the appended claims.

What is claimed is:

1. A foldable, inflatable sectional mattress and a sofa bed of the type including a fixed frame having a pair of upright side frame members, an upright back frame member extending between and secured to the side frame members, a front board extending between and secured to the side frame members, a foldable sectional sofa frame including inner, intermediate and outer frame sections pivotally connected together for movement between a folded, collapsed position within the fixed frame and an extended, horizontal position extending outwardly from the fixed frame, said foldable sectional mattress comprising:

an air inflated inner mattress section, an air inflated intermediate mattress section, and an air inflated outer mattress section, said inner mattress section having a length dimension greater than the combined length dimensions of said intermediate and said outer mattress sections, said outer mattress section having a length dimension greater than said intermediate section, each section having a cover, an upper slide fastener and a lower slide fastener releasably interconnecting the cover of the inner mattress section with the cover of the intermediate mattress section to dispose the sections in end-to-end relation, an upper slide fastener and a lower slide fastener releasably securing the cover of the intermediate mattress section with the cover of the outer mattress section to dispose said sections in end-to-end relation, said mattress being foldable to a collapsed position when one of said slide fasteners between said inner section and said intermediate section is unfastened, whereby the other slide fastener between the inner mattress section and the intermediate mattress section functions as a hinge to permit swinging movement between the inner section relative to the intermediate and outer sections to a folded position, said inner section overlying said intermediate and outer sections when in the folded position and defining a seat for the fixed frame of the sofa bed, said intermediate section when in the folded position being positioned rearwardly of the outer section and below the rear end portion of the inner section, said sectional mattress being folded and unfolded independently of the folding and unfolding of the foldable sofa frame.

2. The inflatable sectional mattress as defined in claim 1 wherein each mattress section has a valve opening in one side thereof, a removable cover for each valve opening, said valve opening in one section being located on the same side as the opening in the other sections.

3. The inflatable sectional mattress as defined in claim 2 wherein said sections have a thickness dimension corresponding to the thickness dimension of a conventional mattress.

* * * * *